United States Patent [19]

Marechal

[11] 4,176,905

[45] Dec. 4, 1979

[54] FLEXIBLE ELECTRICAL CONTACT

[75] Inventor: Gilles Marechal, Paris, France

[73] Assignee: Societe d'Exploitation des Procedes Marechal SEPM, Paris, France

[21] Appl. No.: 930,256

[22] Filed: Aug. 1, 1978

Related U.S. Application Data

[63] Continuation of Ser. No. 791,747, Apr. 28, 1977, abandoned.

[30] Foreign Application Priority Data

Sep. 22, 1976 [FR] France ..... 76 28500

[51] Int. Cl.[2] ..... H01R 13/16

[52] U.S. Cl. ..... 339/255 R; 174/128 R

[58] Field of Search ..... 339/255 R; 174/117 M, 174/124 R, 126 R, 128 R

[56] References Cited

U.S. PATENT DOCUMENTS 2,978,530 4/1961 Braeckman ..... 174/128 R

FOREIGN PATENT DOCUMENTS 624324 6/1949 United Kingdom ..... 339/255 R 1389301 4/1975 United Kingdom ..... 339/255 R

*Primary Examiner*—Joseph H. McGlynn

*Attorney, Agent, or Firm*—Edwin E. Greigg

[57] ABSTRACT

An electrical contact having a base and an axially aligned reciprocable head connected to the base by a flexible cable constructed from a plurality of strands made from thin filamentary wires. The strands are twisted in the opposite direction to the thin filamentary wires and are subsequently plaited to form the cable. A helical spring surrounds and preloads the flexible cable and urges the contact pad into engagement with an electrical element.

4 Claims, 5 Drawing Figures

FLEXIBLE ELECTRICAL CONTACT

This is a continuation, of application Ser. No. 791,747, filed Apr. 28, 1977 now abandoned.

BACKGROUND OF THE INVENTION

The invention relates to an electrical contact having a contact head movable toward and away from a base and connected to the base by an axially collapsible flexible connector surrounded by a helical compression spring urging the contact head away from the base.

Such electrical contacts are well known. In use the contact is situated in a guide relative to which the contact head is movable. The contact head in its extended state rests against a shoulder in the guide and is movable away from the shoulder upon engagement with an opposing contact, which may itself be rigid or elastic. The movable contact head is pressed against the shoulder or the opposing contact by the action of the spring surrounding the flexible connector.

These electrical contacts represent a great improvement as compared to the prior rigid connectors, but special care should be applied to reduce the ohmic voltage drop of the current traversing them as much as possible. This involves proper selection of the materials (brass, copper, silver pellet on the contact tip)—improvement of the intermediate contacts (the connections between the flexible connector and the contact head and the base etc.). Since the apparatus of these electrical contacts, hereinafter referred to as axial thrust contacts, these various features have formed the objects of numerous improvements some of which have been patented.

It is also of importance to establish a particular pressure between the opposed contacts. In practice, this should in the first place be adequate to assure a satisfactory contact on the one hand. According to the laws of Amonton state, the area of the true contact surface is proportional to the force applying the two conductors against each other, this finding being explained on the basis of flattening of small peaks to be on all surfaces even the most highly polished. Secondly it is advantageous that the thrust should be practically constant throughout the action, to prevent excessive force upon engagement. Use should consequently be made of a prestressed spring rather than a spring near its extended state so that an appreciable residual elastic force should be present when the contacts are apart. It is in order to prevent deterioration of the flexible connector and of its fittings, that the contact head abuts the shoulder of its guiding well when the opposed contacts are apart. In this manner, the flexible connector is never in the maximum elongation position.

A tubular metal braid or hollow braid whereof the deformation which by inflation allows a substantial longitudinal collapse of the order of 30%, has hitherto been used as a flexible connector in known axial thrust contacts. A connector of this kind has a number of shortcomings.

The properties of the connector should be selected as a function of the current intensity in accordance with the standards adopted and, as the cross section is annular it is quite obvious that the diameter of the middle portion of the conductor at rest is appreciably greater than that which a non-tubular cable of identical useful cross section would have. However, any increase of diameter of the connector implies an increase of the diameter of the spring and of the surrounding guide and thus an increase in the bulk and cost price of the device. This then leads to selecting the minimum value compatible with the current intensity for the useful cross section which results in increased Joule heating and a reduction in mechanical strength.

Apart from the total mechanical strength which decreases with each action, each strand weakening by undergoing an increase (upon engagement) and then a reduction (upon separation) of its radius or curvature, account should also be taken of the wear caused by friction between strands. There are in effect two sources of wear. The outer strands rub against the turns of the spring upon each expansion, unless of course a spring of sufficiently large diameter is selected, but this leads back to the disadvantage of bulk and of an increase in cost price. Occasionally, it even happens that strands are gripped and finally severed between the consecutive turns of the spring. Secondly the interlaced strands of the braid rub on each other. Strands are thus severed after repeated operation, which obviously results in an increase in the electrical resistance of the connector and to an increase of the voltage drop across it. As a rule, it is estimated that a contact should be scrapped when the increase in resistance reaches 10%.

In the optimum conditions regarding materials, the length/diameter ratio and the deflection (difference between the length at rest and the length under compression) the tubular braidings allow approximately 5000 operations before the increase in the electrical resistance reaches 10%.

This maximum number of operations is insufficient in many cases, and it is desirable to prolong the tip of the axial thrust contact.

OBJECT AND SUMMARY OF THE INVENTION

According to the present invention there is provided an electrical contact having a contact head movable toward and away from a base and connected to the base by an axially collapsible flexible connector and a helical spring surrounding the flexible connector and serving to urge the contact head away from the base, wherein the flexible connector comprises a plaited cable formed by plaiting a plurality of cords each formed by twisting a plurality of strands each, in turn, formed by twisting a plurality of filaments, the filaments in the strands being twisted in the opposite sense to the twisting of the strands in each cord.

Clearly, a cable eliminates the disadvantage of the tubular braid with respect to the bulk ratio between the useful cross section and the diameter. Furthermore, the cable is as later described more wear resistant providing an increased life.

The plaiting pitch, that is to say the angle between each cord and a plane perpendicular to the cable axis is of importance for reducing the wear on the filaments. The best result is obtained if this angle is very little smaller than 70°. Satisfactory results are obtained in the range of 60° to 75°.

The invention will now be described further, by way of example with reference to the accompanying drawings, in which:

DESCRIPTION OF THE PREFERRED EMBODIMENTS

Figure 1A:
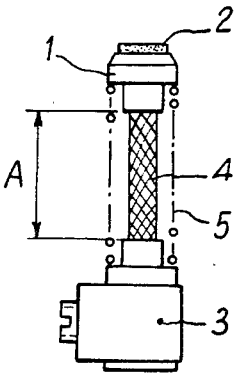
FIGS. 1A and 1B diagrammatically illustrate an axial thrust contact, respectively before and after being installed in its insulating guide.
Figure 1B:
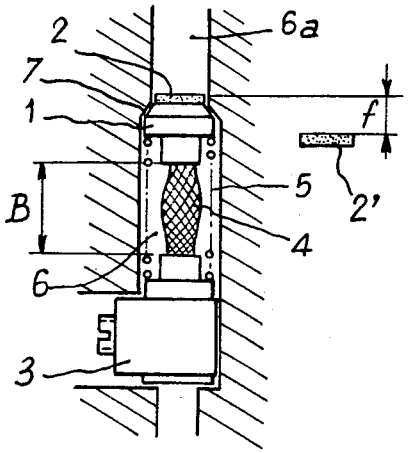

In FIGS. 1A and 1B, an axial thrust contact comprises a contact head 1 provided with a contact pad 2 and a base 3 acting as a terminal for connection to an electrical head.

The head 1 and the base 3 are connected by a flexible connector 4 surrounded by a non-magnetic steel helical spring (the steel complying with U.S. Standard AISI 303) which bears at one end on a shoulder of the head 1 and at the other end on a shoulder of the base. The contact is intended to be installed in a device, for example in a plug or a socket, within a guide or locating well 6 (FIG. 1B). Within this well 6, the base 3 is at the bottom and an inner shoulder 7 forms a step to limit the upward displacement (as viewed) of the head 1, the well being continued by an extension 6a of lesser diameter intended to receive and guide the opposing contact (not illustrated). Even when at rest, the spring 5 exerts a residual elastic force, i.e., the length denoted by A in FIG. 1A for the free portion of the conductor 4 in the position of maximum extension, is greater than its length B when the connector is installed in its well 6 (FIG. 1B) because the head 1 abuts the shoulder 7. In other words, when fully extended in the well 6 the connector 4 has already suffered contraction, the contraction increasing upon engagement with the opposing contact, so that the head 1 moves back until the contact pad 2 reaches the level shown at 2' in FIG. 1B. In the active position, the contact has a "deflection" f which is equal to the difference in level between the positions shown at 2 and 2'.

All the statements made also apply to the conventional axial-thrust contacts which make use of a tubular braiding as a flexible connector while observing however that the length B is then rather close to the length A, that is to say that the initial deflection of the connector when at rest, is small.

Figure 2:
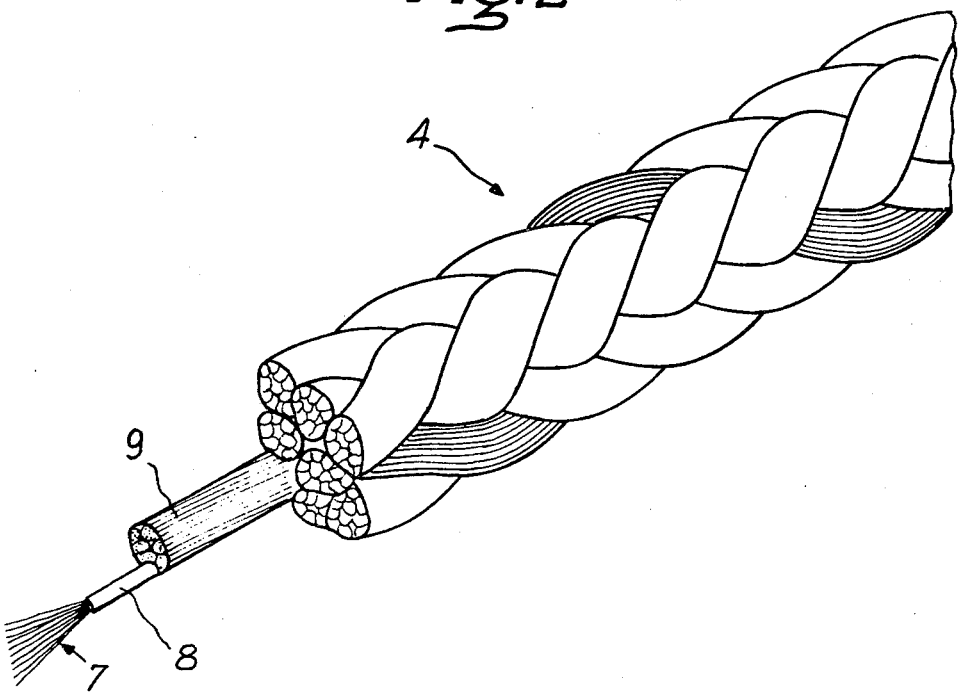
FIG. 2 is a diagrammatic view to an enlarged scale of a plaited cable constituting the flexible connector of FIGS. 1A and 1B.

The flexible connector in the present embodiment is a plaited cable 4 shown diagrammatically in perspective in FIG. 2. Strands 8 are formed by twisting thin wires of filaments 7 (diameter of approximately 0.05 mm). Cords 9 are formed by twisting the strands, the twisting being performed in the opposite direction to that of the wires, and the cords are plaited to form the cable 4. A satisfactory method of obtaining different useful cross sections of cable as a function of the maximum rated permissible current intensity in different contacts entails using the same number of cords for all the cables, for example 8, and the same number of filaments for all strands, for example sixty four, while varying the number of strands per cord. With threads of a diameter of 5/100 mm, and with the aforesaid numbers of threads and cords, a useful cross section of 3.010 $mm^2$ will be obtained with three strands per cord (to take up to 16 Amps), of 4.014 $mm^2$ with four strands per cord (acceptable intensity 32 Amps), of 10.035 $mm^2$ with ten strands per cord (acceptable intensity 63 Amps), etc.

For the cable 4 to allow for deformation by enlargement, it is necessary that the initial shortening should be substantial, of the order of 20 to 33%, that is to say that the length B should be comprised of between 0.67 and 0.8 of A (A=length under maximum extension).

The repeated operations of the contact finally result in severing threads 7 which results in an increase in the electrical resistance of the cable 4 by reduction of the useful cross section. As earlier stated, a contact should be replaced when the increase in resistance reaches 10%.

It has been found that the number of operations needed to reach this increase of 10% is primarily a function of the plaiting angle of the cable, that is to say, the angle of each cord relative to the plane perpendicular to the axis of the cable.

Figure 3:
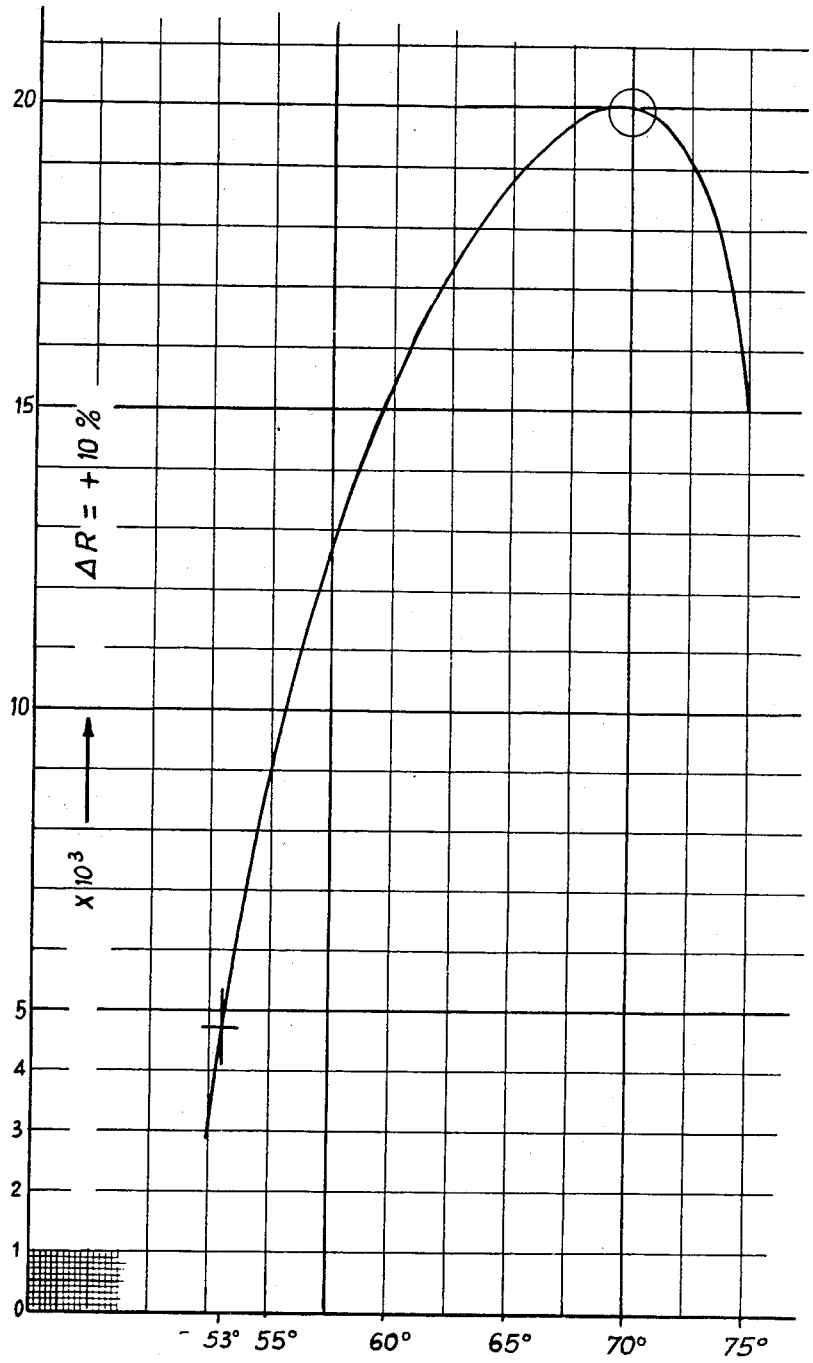
FIG. 3 is a graph of the number of operations leading to an increase of 10% in the resistance of the contact plotted against the plaiting angle of the cords.

In the graph illustrated in FIG. 3, the values of the plaiting angle are plotted as abscissae and the number of operations causing this increase of 10%, i.e., the life of the contact are plotted as ordinates. It is apparent that this graph is of generally parabolic bell-like form whereof the descending branch has a steeper slope than the rising branch. The maximum is obtained for a plaiting angle very little smaller than 70°. Satisfactory results are obtained above 60° and 75° should not be reached or exceeded since the drop is then almost vertical.

It is evident that for a given cross section and deflection f, the maximum number of actions is also a function of the initial length A of the cable. The graph of FIG. 3 corresponds to a 4 $mm^2$ cable (for 32 Amps) with a deflection f of 7.5 mms and a length A of 28 mms. What is remarkable however is that for this same deflection and this same cross section, all the graphs plotted for different lengths indicate the same value of 70° (or more precisely 69°) for the maximum, with practically equal numbers of operations for 60° and 75°, the graphs are simply more or less flattened and the maximum number of actions (still for 70°) amounts to 5000 for a length of 21 mms, 13,500 for 24 mms and 20,000 (FIG. 3) for 28 mms.

Figure 4:
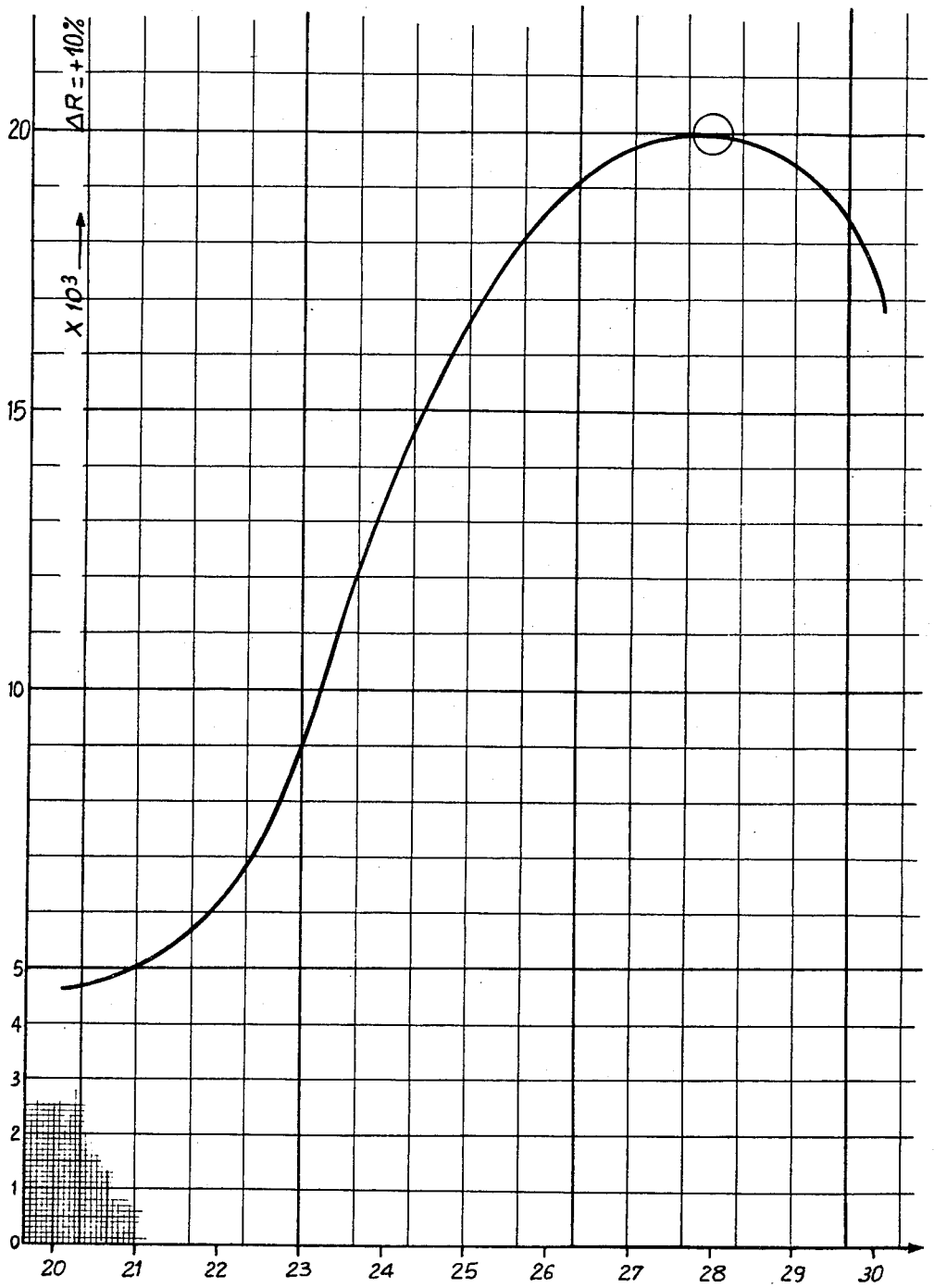
FIG. 4 is a graph of the number of operations leading to 10% increase in resistance for a plaiting of 70°, a useful cross section of 4 $mm^2$ and a deflection of 7.5 mm, plotted against the initial length of the conductor.

It is useful thereupon to plot the graph giving the maximum number of operations as a function of the initial length A, for a plaiting angle of 70° and with all other parameters (B, f and useful cross section) remaining unchanged. A graph of this kind is that which is illustrated in FIG. 4 for B=18 mms, f=7.5 mms and a cross section of 4 $mm^2$. The values specified in the foregoing are certainly encountered again, namely 5000 for 21 mms, 13,500 for 24 mms and 20,000 for 28 mms, which represents a maximum, the graph then "dropping" rather quickly. No law of any kind could be derived at the actual testing stage, and the sole recourse is to plot "double-entry" graphs (B and f) per useful cross section experimentally, that is to say per acceptable intensity.

In any event, it has been noted that the replacement within an axial thrust contact or connector of the conventional tubular braiding by a plaited cable enable the life to be increased by a factor of as small as three or four.

What is claimed is:

1. An electrical contact having a contact head movable toward and away from a base and connected to the base by an axially collapsible flexible connector and a helical spring surrounding the flexible connector and serving to urge the contact head away from the base, wherein the flexible connector comprises a plaited cable formed by plaiting together a plurality of cords into a solid mass, each of said cords having an outer surface formed by a plurality of strands twisted together in one direction into a solid mass, each of said strands comprising a plurality of filaments twisted together in the other direction.

2. An electrical contact as claimed in claim 1, arranged within a guide having a shoulder against which the contact heads abut when the contact is in a rest position, and wherein when the contact head is resting against the shoulder the flexible connector is compressed by 20 to 33% of its length in the fully extended state outside the guide.

3. An electrical contact as claimed in claim 1, in which the plaiting pitch of the cords is such that each cord makes an angle of between 60° and 75° with the plane normal to the axis of the cable.

4. An electrical contact as claimed in claim 3, in which each cord makes an angle of substantially 70° with the plane normal to the axis of the cable.

* * * * *